US011015598B2

(12) United States Patent
Antimonov et al.

(10) Patent No.: US 11,015,598 B2
(45) Date of Patent: May 25, 2021

(54) COMPRESSOR HAVING BUSHING

(71) Applicant: Emerson Climate Technologies, Inc., Sidney, OH (US)

(72) Inventors: Mikhail A. Antimonov, Beavercreek, OH (US); Roy J. Doepker, Lima, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 127 days.

(21) Appl. No.: 16/253,030

(22) Filed: Jan. 21, 2019

(65) Prior Publication Data

US 2019/0316584 A1 Oct. 17, 2019

Related U.S. Application Data

(60) Provisional application No. 62/656,034, filed on Apr. 11, 2018.

(51) Int. Cl.
*F04C 29/00* (2006.01)
*F04C 18/02* (2006.01)
(Continued)

(52) U.S. Cl.
CPC ..... *F04C 18/0215* (2013.01); *F04C 27/009* (2013.01); *F04C 2240/56* (2013.01)

(58) Field of Classification Search
CPC ..... F04C 18/0215; F04C 27/009; F04C 18/0253; F04C 29/0057; F04C 18/0207; F04C 29/0071; F01C 1/0215
See application file for complete search history.

(56) References Cited

U.S. PATENT DOCUMENTS 4,300,875 A 11/1981 Fischer et al.
4,314,796 A * 2/1982 Terauchi ..... F04C 18/0215 417/294
(Continued)

FOREIGN PATENT DOCUMENTS

CN 1186174 A 7/1998
CN 1249401 A 4/2000
(Continued)

OTHER PUBLICATIONS

English translation of JP 58096193 by J Piat Pat Jul. 5, 2020.*
(Continued)

*Primary Examiner* — Deming Wan
(74) *Attorney, Agent, or Firm* — Hamess, Dickey & Pierce, P.L.C.

(57) ABSTRACT

A compressor includes a non-orbiting scroll, an orbiting scroll, a driveshaft, a bearing housing and a bushing. The non-orbiting scroll includes a first spiral wrap. The orbiting scroll includes an end plate having a first side and a second side. The first side has a second spiral wrap that extends therefrom and meshingly engages with the first spiral wrap of the non-orbiting scroll. The second side has a hub extending therefrom. The driveshaft has a crankpin that is received in the hub and that drives the orbiting scroll. The bushing includes a first member and a second member. The first member is disposed within the hub of the orbiting scroll between the hub and the crankpin of the driveshaft. The second member extends radially from the first member and is disposed between the hub and the bearing housing.

20 Claims, 6 Drawing Sheets

(51) Int. Cl.

| | |
|---|---|
| ***F04C 23/00*** | (2006.01) |
| ***F04C 27/00*** | (2006.01) |
| ***F01C 1/02*** | (2006.01) |

(56) References Cited

U.S. PATENT DOCUMENTS

| | | | | |
|---|---|---|---|---|
| 4,325,683 | A | 4/1982 | Miyazawa | |
| 4,435,137 | A | 3/1984 | Terauchi | |
| 4,702,683 | A | 10/1987 | Inaba et al. | |
| 4,877,382 | A | 10/1989 | Caillat et al. | |
| 4,993,928 | A | 2/1991 | Fraser, Jr. | |
| 5,024,312 | A | 6/1991 | Godbersen | |
| 5,186,546 | A | 2/1993 | Abe | |
| 5,295,813 | A | 3/1994 | Caillat et al. | |
| 5,370,513 | A | 12/1994 | Fain | |
| 5,378,129 | A | 1/1995 | Dunaevsky et al. | |
| 5,520,524 | A | 5/1996 | Takemoto et al. | |
| 5,520,527 | A | 5/1996 | Kim | |
| 5,545,019 | A | 8/1996 | Beck et al. | |
| 5,562,435 | A | 10/1996 | Cho et al. | |
| RE36,604 | E | 3/2000 | Sano et al. | |
| 6,056,523 | A | 5/2000 | Won et al. | |
| 6,079,962 | A | 6/2000 | Seibel et al. | |
| 6,089,840 | A | 7/2000 | Iizuka et al. | |
| 6,106,251 | A | 8/2000 | Monnier et al. | |
| 6,139,294 | A | 10/2000 | Haller | |
| 6,139,295 | A | 10/2000 | Utter et al. | |
| 6,146,119 | A | 11/2000 | Bush et al. | |
| 6,179,591 | B1 | 1/2001 | Clendenin et al. | |
| 6,189,248 | B1 | 2/2001 | Nagel et al. | |
| 6,193,489 | B1 | 2/2001 | Tarng et al. | |
| 6,273,616 | B1 | 8/2001 | Pflug | |
| 6,398,530 | B1 | 6/2002 | Hasemann | |
| 6,428,294 | B1 | 8/2002 | Fenocchi | |
| 6,454,551 | B2 | 9/2002 | Kuroki et al. | |
| 6,695,600 | B2 | 2/2004 | Koo et al. | |
| 6,709,247 | B1 | 3/2004 | Clendenin et al. | |
| 6,821,092 | B1 | 11/2004 | Gehret et al. | |
| 7,273,363 | B1 | 9/2007 | Sun et al. | |
| 7,338,263 | B2 | 3/2008 | Young | |
| 7,661,939 | B2 | 2/2010 | Su et al. | |
| 8,186,981 | B2 | 5/2012 | Sugimoto et al. | |
| 9,115,718 | B2 | 8/2015 | Ignatiev et al. | |
| 9,188,124 | B2 | 11/2015 | Utpat et al. | |
| 9,377,022 | B2 | 6/2016 | Ignatiev et al. | |
| 10,156,236 | B2 | 12/2018 | Utpat et al. | |
| 10,215,175 | B2 | 2/2019 | Ignatiev et al. | |
| 10,830,236 | B2 | 11/2020 | Ignatiev et al. | |
| 2002/0057975 | A1 | 5/2002 | Nakajima et al. | |
| 2002/0098102 | A1 | 7/2002 | Gennami et al. | |
| 2003/0077193 | A1 | 4/2003 | Skinner | |
| 2004/0184931 | A1 | 9/2004 | Millet et al. | |
| 2005/0226755 | A1 | 10/2005 | Tsuchiya et al. | |
| 2007/0092390 | A1 | 4/2007 | Ignatiev et al. | |
| 2009/0246057 | A1 | 10/2009 | Sugimoto et al. | |
| 2009/0246059 | A1 | 10/2009 | Nakamura et al. | |
| 2010/0111709 | A1 | 5/2010 | Jayanth | |
| 2010/0166589 | A1 | 7/2010 | Iwano et al. | |
| 2011/0194966 | A1 | 8/2011 | Takeuchi et al. | |
| 2012/0257996 | A1 | 10/2012 | Smith | |
| 2012/0258003 | A1 | 10/2012 | Hahn | |
| 2014/0219850 | A1 | 8/2014 | Ignatiev et al. | |
| 2014/0294643 | A1 | 10/2014 | Koyama et al. | |
| 2014/0356209 | A1* | 12/2014 | Ignatiev | F04C 18/0215 418/55.5 |
| 2015/0361983 | A1 | 12/2015 | Ignatiev et al. | |
| 2016/0069348 | A1 | 3/2016 | Utpat et al. | |
| 2017/0037850 | A1 | 2/2017 | Ignatiev et al. | |
| 2017/0067508 | A1 | 3/2017 | Sawamoto et al. | |
| 2017/0268340 | A1* | 9/2017 | Ootani | F01C 21/008 |
| 2018/0023570 | A1 | 1/2018 | Huang et al. | |
| 2019/0345939 | A1 | 11/2019 | Antimonov et al. | |

FOREIGN PATENT DOCUMENTS

| | | | | | |
|---|---|---|---|---|---|
| CN | 1126871 | C | | 11/2003 | |
| CN | 1632317 | A | | 6/2005 | |
| CN | 101255864 | A | | 9/2008 | |
| CN | 101545483 | A | | 9/2009 | |
| CN | 101576072 | A | | 11/2009 | |
| CN | 101684811 | A | | 3/2010 | |
| CN | 102705235 | A | | 10/2012 | |
| CN | 203453056 | U | | 2/2014 | |
| CN | 203822627 | U | | 9/2014 | |
| CN | 107575380 | A | | 1/2018 | |
| CN | 107781160 | A | | 3/2018 | |
| CN | 107893757 | A | | 4/2018 | |
| CN | 210087600 | U | | 2/2020 | |
| CN | 210423002 | U | | 4/2020 | |
| EP | 1253323 | B1 | | 3/2005 | |
| JP | 58096193 | A | * | 6/1983 | F04C 29/0057 |
| JP | 2000161256 | A | | 6/2000 | |
| JP | 2009114943 | A | | 5/2009 | |
| JP | 2012132409 | A | | 7/2012 | |
| KR | 20000006361 | A | | 1/2000 | |
| KR | 20090077294 | A | | 7/2009 | |
| KR | 100996628 | B1 | | 11/2010 | |
| WO | WO-9410425 | A1 | | 5/1994 | |
| WO | WO-2010113794 | A1 | | 10/2010 | |
| WO | WO-2014155546 | A1 | | 10/2014 | |
| WO | WO-2016031276 | A1 | | 3/2016 | |
| WO | WO-2017057159 | A1 | | 4/2017 | |

OTHER PUBLICATIONS

Office Action regarding U.S. Appl. No. 14/832,371, dated Jun. 7, 2019.

Office Action regarding Korean Patent Application No. 10-2018-7005832, dated Jul. 17, 2019. Translation provided by KS Koryo International IP Law Firm.

Office Action regarding Chinese Patent Application No. 201680051384.7, dated Aug. 2, 2019. Translation provided by Unitalen Attorneys at Law.

Office Action regarding U.S. Appl. No. 14/832,371, dated Sep. 4, 2019.

Applicant-Initiated Interview Summary regarding U.S. Appl. No. 14/832,371, dated Nov. 26, 2019.

Office Action regarding U.S. Appl. No. 14/832,371, dated Feb. 13, 2020.

Office Action regarding U.S. Appl. No. 16/252,997, dated Apr. 24, 2020.

Office Action regarding Chinese Patent Application No. 201910288717.3, dated Jun. 12, 2020. Translation provided by Unitalen Attorneys at Law.

U.S. Appl. No. 16/252,997, filed Jan. 21, 2019, Mikhail A. Antimonov et al.

International Search Report regarding International Patent Application No. PCT/US2014/012319, dated Apr. 28, 2014.

Written Opinion of the International Searching Authority regarding International Application No. PCT/US2014/012319, dated Apr. 28, 2014.

Office Action regarding U.S. Appl. No. 14/159,526, dated Oct. 1, 2014.

Office Action regarding U.S. Appl. No. 14/159,526, dated Feb. 3, 2015.

Office Action regarding U.S. Appl. No. 13/869,567, dated Mar. 25, 2015.

Notice of Allowance regarding U.S. Appl. No. 14/159,526, dated Apr. 30, 2015.

Office Action regarding Chinese Patent Application No. 201310158952.1, dated May 5, 2015. Translation provided by Unitalen Attorneys at Law.

Notice of Allowance regarding U.S. Appl. No. 13/869,567, dated Sep. 22, 2015.

Office Action regarding Chinese Patent Application No. 201480005721.X, dated Jul. 15, 2016. Translation provided by Unitalen Attorneys at Law.

(56) References Cited

OTHER PUBLICATIONS

International Search Report regarding International Application No. PCT/US2016/045180, dated Oct. 12, 2016.
Written Opinion of the International Searching Authority regarding International Application No. PCT/US2016/045180, dated Oct. 12, 2016.
Office Action regarding Chinese Patent Application No. 201610157658.2, dated Sep. 26, 2017. Translation provided by Unitalen Attorneys at Law.
Restriction Requirement regarding U.S. Appl. No. 15/222,361, dated Jan. 11, 2018.
Office Action regarding U.S. Appl. No. 14/832,371, dated Feb. 1, 2018.
Office Action regarding Indian Patent Application No. 1344/MUM/2012, dated Feb. 12, 2018.
Office Action regarding U.S. Appl. No. 14/941,827, dated Mar. 15, 2018.
Office Action regarding U.S. Appl. No. 15/222,361, dated Apr. 17, 2018.
Office Action regarding Chinese Patent Application No. 201610157658.2, dated May 30, 2018. Translation provided by Unitalen Attorneys at Law.
Office Action regarding Chinese Patent Application No. 201710426869.6, dated Aug. 1, 2018. Translation provided by Unitalen Attorneys at Law.
Office Action regarding U.S. Appl. No. 14/832,371, dated Aug. 24, 2018.
Notice of Allowance regarding U.S. Appl. No. 14/941,827, dated Oct. 18, 2018.
Notice of Allowance regarding U.S. Appl. No. 15/222,361, dated Nov. 6, 2018.
Office Action regarding Chinese Patent Application No. 201680051384.7, dated Nov. 14, 2018. Translation provided by Unitalen Attorneys at Law.
Office Action regarding U.S. Appl. No. 14/832,371, dated Dec. 4, 2018.
Office Action regarding Korean Patent Application No. 10-2018-7005832, dated Feb. 18, 2019. Translation provided by KS Koryo International IP Law Firm.
Kerns, Jeff, "How to Pinpoint the Best Plain Bearing." Machine Design, https://www.machinedesign.com/mechanical-motion-systems/bearings/article/21834926/how-to-pinpoint-the-best-plain-bearing (Oct. 26, 2016).
Advisory Action regarding U.S. Appl. No. 16/252,997, dated Dec. 23, 2020.
Notice of Allowance regarding U.S. Appl. No. 14/832,371, dated Jul. 29, 2020.
Office Action regarding Chinese Patent Application No. 201910389798.6, dated Sep. 1, 2020. Translation provided by Unitalen Attorneys at Law.
Office Action regarding Indian Patent Application No. 1344/MUM/2012, dated Sep. 30, 2020.
Office Action regarding U.S. Appl. No. 16/252,997, dated Oct. 8, 2020.

* cited by examiner

COMPRESSOR HAVING BUSHING

CROSS-REFERENCE TO RELATED APPLICATIONS

This application claims the benefit of U.S. Provisional Application No. 62/656,034, filed on Apr. 11, 2018. The entire disclosure of the above application is incorporated herein by reference.

FIELD

The present disclosure relates to a compressor having a bushing.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a compressor that may include a non-orbiting scroll, an orbiting scroll, a driveshaft, a bearing housing and a bushing. The non-orbiting scroll includes a first spiral wrap. The orbiting scroll includes an end plate having a first side and a second side. The first side has a second spiral wrap that extends therefrom and meshingly engages with the first spiral wrap of the non-orbiting scroll to create fluid pockets therebetween. The second side has a hub extending therefrom. The driveshaft has a crankpin that is received in the hub and that drives the orbiting scroll. The bushing includes a first member and a second member. The first member is disposed within the hub of the orbiting scroll between the hub and the crankpin of the driveshaft. The second member extends radially from an axial end of the first member and is disposed between an axial end of the hub and a surface of the bearing housing.

In some configurations of the compressor of the above paragraph, the orbiting scroll and the bearing housing cooperate to define a biasing chamber.

In some configurations of the compressor of either of the above paragraphs, the bearing housing includes an annular recess formed in the surface thereof. A sealing member may be received in the annular recess formed in the surface of the bearing housing.

In some configurations of the compressor of any of the above paragraphs, the second member extends radially outward from the axial end of the first member.

In some configurations of the compressor of any of the above paragraphs, the second member of the bushing engages the sealing member to seal the biasing chamber.

In some configurations, the compressor of any of the above paragraphs includes a bearing disposed within the hub of the orbiting scroll between the first member of the bushing and the crankpin of the driveshaft.

In some configurations of the compressor of any of the above paragraphs, the bearing is a needle bearing.

In some configurations of the compressor of any of the above paragraphs, a biasing passage is formed in the end plate of the orbiting scroll and provides fluid communication between one of the fluid pockets and the biasing chamber.

In some configurations of the compressor of any of the above paragraphs, the first member of the bushing is press-fitted to an inner diametrical surface of the hub.

In some configurations of the compressor of any of the above paragraphs, the second member of the bushing includes a first end portion and a second end portion. The first end portion may extend radially outward from the axial end of the first member and the second end portion may extend radially inward from the axial end of the first member.

In some configurations of the compressor of any of the above paragraphs, one or both of the first and second end portions of the second member engage the sealing member received in the annular recess formed in the surface to seal the biasing chamber.

In another form, the present disclosure provides a compressor that may include a non-orbiting scroll, an orbiting scroll, a driveshaft, an unloader bushing, a bearing housing and a bushing. The non-orbiting scroll includes a first spiral wrap. The orbiting scroll includes an end plate has a first side and a second side. The first side has a second spiral wrap extending therefrom and meshingly engaged with the first spiral wrap of the non-orbiting scroll to create fluid pockets therebetween. The second side having a hub extending therefrom. The driveshaft has a crankpin received in the hub and driving the orbiting scroll. The unloader bushing is disposed on the crankpin of the driveshaft within the hub of the orbiting scroll. The bearing housing includes an annular recess formed in a lower surface thereof. The bushing includes a first member and a second member. The first member is disposed within the hub of the orbiting scroll between the hub and the crankpin of the driveshaft. The second member extends radially from an axial end of the first member and is disposed between an axial end of the hub and a surface of the bearing housing.

In some configurations of the compressor of the above paragraph, the orbiting scroll and the bearing housing cooperate to define a biasing chamber.

In some configurations of the compressor of either of the above paragraphs, a sealing member is received in the annular recess formed in the surface of the bearing housing.

In some configurations of the compressor of any of the above paragraphs, the second member extends radially outward from an end of the first member.

In some configurations of the compressor of any of the above paragraphs, the second member of the bushing engages the sealing member to seal the biasing chamber.

In some configurations of the compressor of any of the above paragraphs, a biasing passage is formed in the end plate of the orbiting scroll and provides fluid communication between one of the fluid pockets and the biasing chamber.

In some configurations, the compressor of any of the above paragraphs includes a bearing disposed within the hub of the orbiting scroll between the first member of the bushing and the crankpin of the driveshaft.

In some configurations of the compressor of any of the above paragraphs, the bearing is a needle bearing.

In some configurations of the compressor of any of the above paragraphs, the first member of the bushing is press-fitted to an inner diametrical surface of the hub.

In some configurations of the compressor of any of the above paragraphs, the second member of the bushing includes a first end portion and a second end portion. The first end portion may extend radially outward from the axial end of the first member and the second end portion may extend radially inward from the axial end of the first member.

In some configurations of the compressor of any of the above paragraphs, one or both of the first end portion and the second end portion engages the sealing member received in the annular recess formed in the surface to seal the biasing chamber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
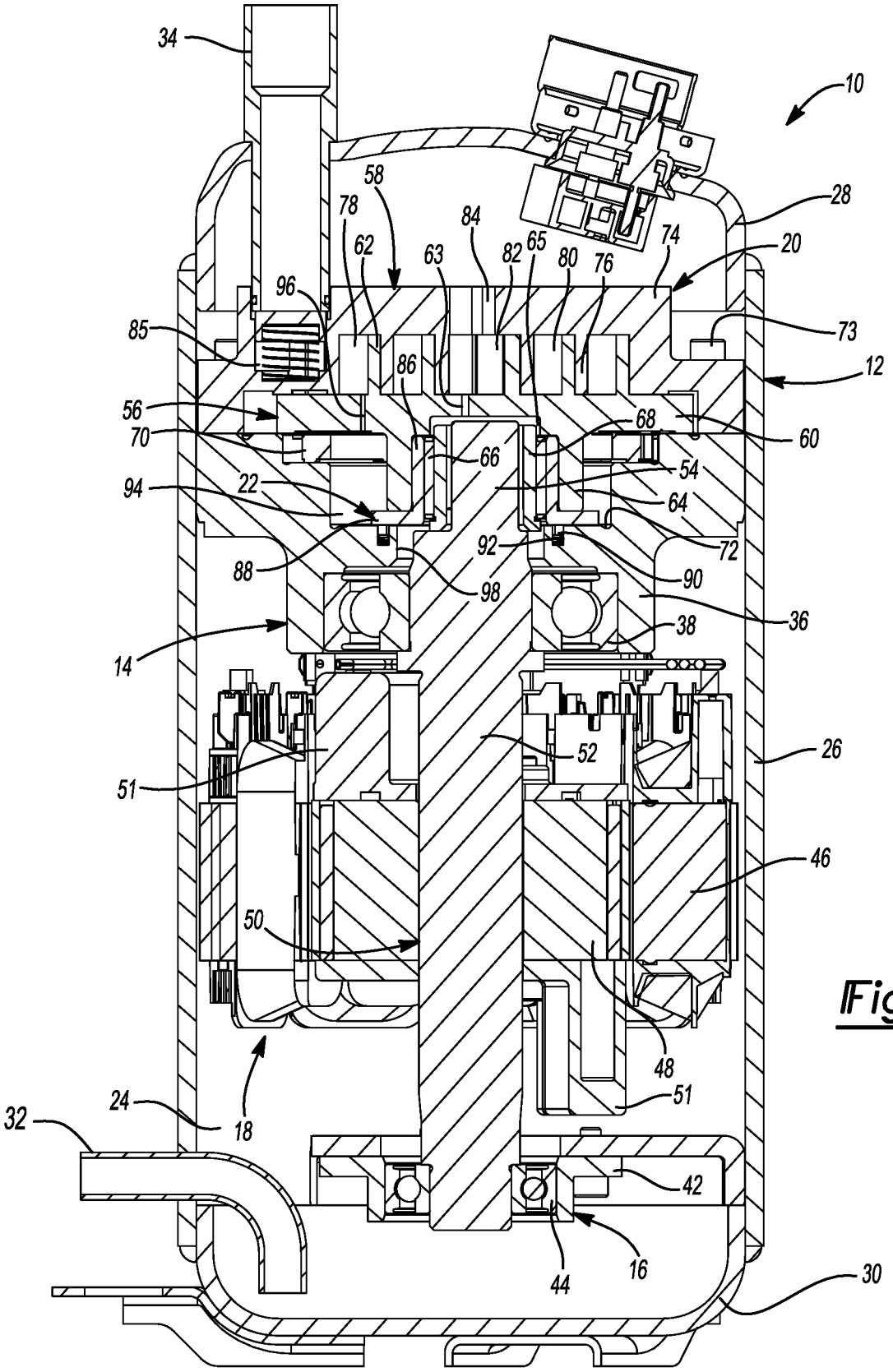
FIG. 1 is a cross-sectional view of a compressor having a bushing according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
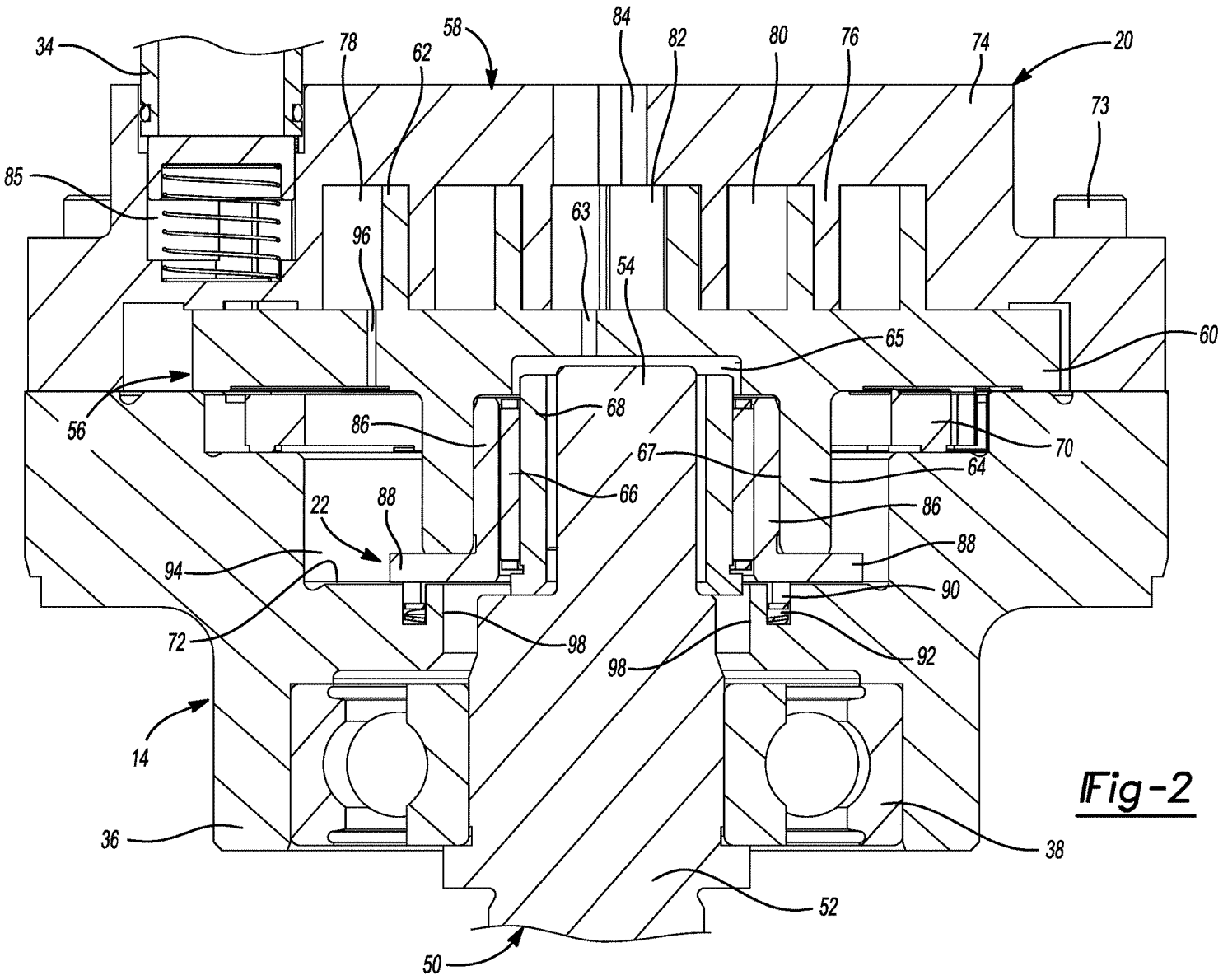
FIG. 2 is a partial cross-sectional view of the compressor of FIG. 1.
Figure 3:
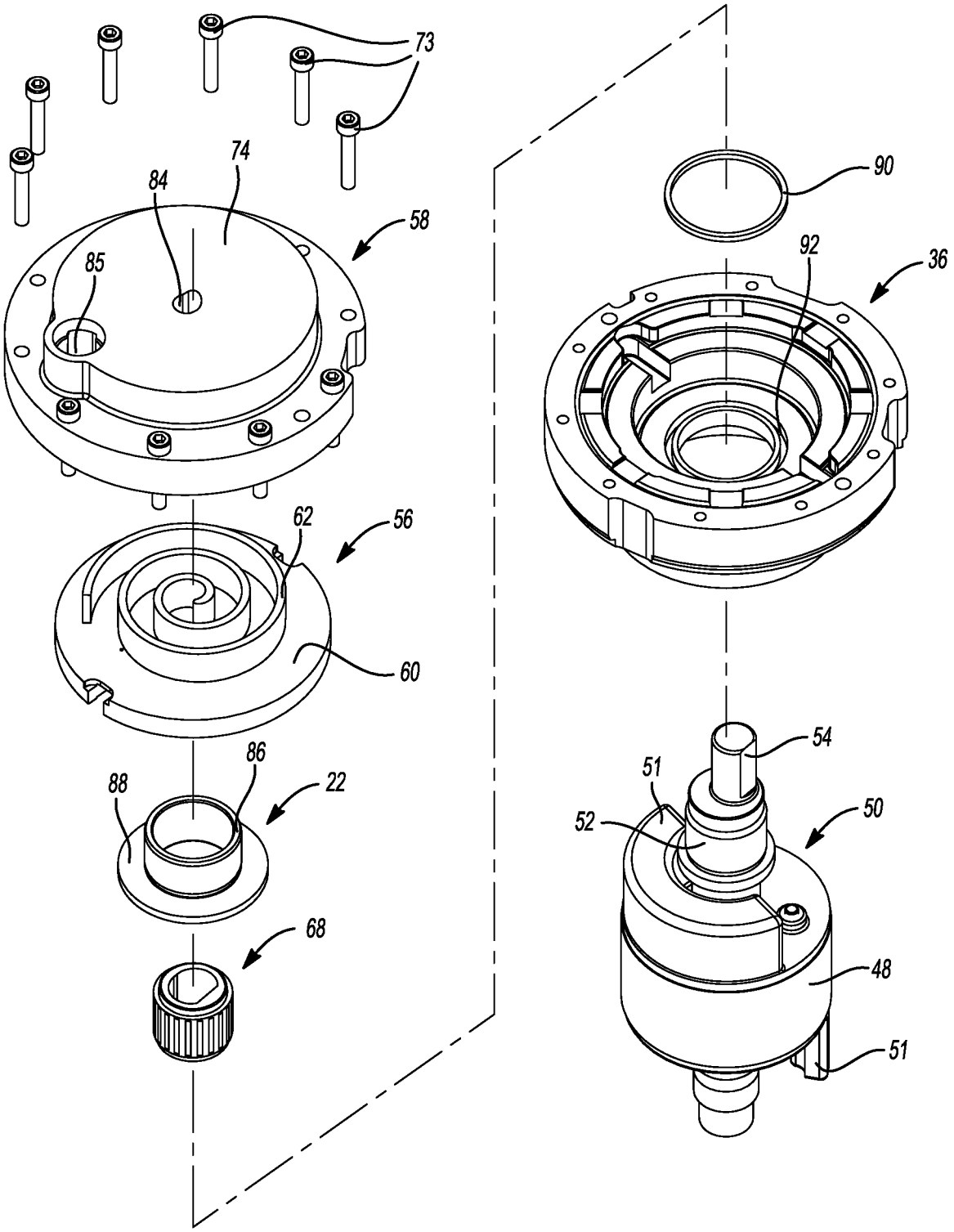
FIG. 3 is an exploded view of a compression mechanism, a motor assembly, a bearing assembly and the bushing of the compressor of FIG. 1.

With reference to FIGS. 1-3, a compressor 10 is provided (FIG. 1). The compressor 10 may be a high-side scroll compressor including a hermetic shell assembly 12, first and second bearing assemblies 14, 16, a motor assembly 18, a compression mechanism 20 and a hub bushing 22.

As shown in FIG. 1, the shell assembly 12 may define a high-pressure discharge chamber 24 (containing compressed working fluid) and may include a cylindrical shell 26, a first end cap 28 at one end thereof, and a base or second end cap 30 at another end thereof. The high-pressure working fluid may exit the discharge chamber 24 through a discharge fitting 32 attached to the shell assembly 12 (e.g., at the shell 26 or either end cap 28, 30). A suction-inlet conduit 34 may be attached to the shell assembly 12 (e.g., at the first end cap 28) and may extend through the discharge chamber 24 and provide suction-pressure working fluid to the compression mechanism 20. Suction-pressure fluid within the suction-inlet conduit 34 may be fluidly isolated or sealed off from the discharge chamber 24.

The first and second bearing assemblies 14, 16 may disposed entirely within the discharge chamber 24. The first bearing assembly 14 may include a first bearing housing 36 and a first bearing 38. The first bearing housing 36 may be fixed to the shell assembly 12. The first bearing housing 36 houses the first bearing 38. The second bearing assembly 16 may include a second bearing housing 42 and a second bearing 44. The second bearing housing 42 is fixed to the shell assembly 12 and supports the second bearing 44.

As shown in FIG. 1, the motor assembly 18 may be disposed entirely within the discharge chamber 24 and may include a motor stator 46, a rotor 48 and a driveshaft 50. The stator 46 may be fixedly attached (e.g., by press-fit) to the shell 26. The rotor 48 may be press fit on the driveshaft 50 and may transmit rotational power to the driveshaft 50. In some configurations, a counterweight 51 may be coupled to each side of the rotor 48. The driveshaft 50 may include a main body 52 and an eccentric crank pin 54 extending from an axial end of the main body 52. The main body 52 may be received in the first and second bearings 38, 42 and may be rotatably supported by the first and second bearing assemblies 14, 16. The first and second bearings 38, 42 may define a rotational axis of the driveshaft 50. The crank pin 54 may engage the compression mechanism 20.

The compression mechanism 20 may be disposed entirely within the discharge chamber 24 and may include an orbiting scroll 56 and a non-orbiting scroll 58. The orbiting scroll 56 may include an end plate 60 having a spiral wrap 62 extending from a first side of the end plate 60. An annular hub 64 may extend from a second side of the end plate 60 and may include a cavity 65 in which a drive bearing 66, an unloader bushing 68, the crank pin 54 and the hub bushing 22 may be disposed (FIGS. 1 and 2). The drive bearing 66 may be received within the hub bushing 22. The crank pin 54 may be received within the unloader bushing 68.

As shown in FIGS. 1 and 2, an Oldham coupling 70 may be engaged with the end plate 60 and either the non-orbiting scroll 58 or the first bearing housing 36 to prevent relative rotation between the orbiting scroll 56 and the non-orbiting scroll 58.

As shown in FIGS. 1 and 2, the non-orbiting scroll 58 may be attached to the first bearing housing 36 via fasteners 73 (e.g., bolts) and may include an end plate 74 and a spiral wrap 76 projecting from the end plate 74. The spiral wrap 76 may meshingly engage the spiral wrap 62 of the orbiting scroll 56, thereby creating a series of moving fluid pockets therebetween. The fluid pockets defined by the spiral wraps 62, 76 may decrease in volume as they move from a radially outermost position 78 to a radially intermediate position 80 to a radially innermost position 82 throughout a compression cycle of the compression mechanism 20. The suction-inlet conduit 34 is fluidly coupled with a suction inlet 85 in the end plate 74 and provides a suction-pressure working fluid to the fluid pockets at the radially outermost positions 78. The end plate 74 of the non-orbiting scroll 58 may include a discharge passage 84. The discharge passage 84 may be in communication with the fluid pocket at the radially inner most position 82. The discharge passage 84 may be in communication with the discharge chamber 24 and provide compressed working fluid to the discharge chamber 24.

The hub bushing 22 may be disposed within the annular hub 64 (FIGS. 1 and 2). The hub bushing 22 may be an annular member having a first member 86 (e.g., an axially extending portion) and a second member 88 (e.g., a radially extending portion). As shown in FIGS. 1 and 2, the first member 86 may be disposed axially within the hub 64 between the hub 64 and the drive bearing 66. In some configurations, the first member 86 may fixedly engage an inner diametrical surface 67 (FIG. 2) of the hub 64 by a press fit or interference fit, for example.

The second member 88 may extend radially outwardly from an axial end of the first member 86 and may be disposed between a distal axial end of the hub 64 and a lower surface 72 (i.e., surface 72 extending perpendicular to a rotational axis of the driveshaft 50 and facing toward end plate 60 of the orbiting scroll 56) of the first bearing housing 36. A sealing member 90 (e.g., an O-ring or annular seal) disposed in an annular recess 92 in the lower surface 72 may sealingly engage the second member 88 and the first bearing housing 36 such that a biasing chamber 94 defined between the first bearing housing 36 and the orbiting scroll 56 is sealed. A biasing passage 96 may be formed in the end plate 60 of the orbiting scroll 56 and may provide communication between one of the fluid pockets at the radially outermost position 78 and the biasing chamber 94.

In some configurations, the biasing chamber 94 receives fluid from the fluid pocket in the radially outermost position 78 and/or the radially intermediate position 80 through the biasing passage 96. In some configurations, the biasing passage 96 may provide communication between one of the fluid pockets at the radially intermediate position 80 and the biasing chamber 94. In some configurations, the biasing passage 96 may provide communication between the biasing chamber 94 and one of the fluid pockets at the radially outermost position 78 during a portion of the driveshaft 50 revolution, and between the biasing chamber 94 and one of the fluid pockets at the radially intermediate position 80 during another portion of the driveshaft 50 revolution.

In some configurations, the biasing chamber 94 receives fluid from the fluid pocket in the radially intermediate position 80 and the radially inner most position 82 through the biasing passage 96. The biasing passage 96 may provide communication between the biasing chamber 94 and one of the fluid pockets at the radially inner most position 82 during a portion of the driveshaft 50 revolution, and between the biasing chamber 94 and one of the fluid pockets at the radially intermediate position 80 during another portion of the driveshaft 50 revolution.

The sum of forces acting on the biasing chamber 94, the discharge chamber 24 and the fluid pockets are such that a net axial biasing force is exerted on the orbiting scroll 56 urging the orbiting scroll 56 toward the non-orbiting scroll 58.

In some configurations, a plurality of biasing chambers (not shown) may be defined between the first bearing housing 36 and the orbiting scroll 56 with each biasing chamber communicating with one of the fluid pockets. In such configurations, a sealing member (not shown) of a plurality of sealing members (not shown) may seal a respective biasing chamber of the plurality of biasing chambers such that each biasing chamber includes a different gas pressure. In this way, the sum of forces acting on the plurality of biasing chambers, the discharge chamber 24 and the fluid pockets are such that a net axial biasing force is exerted on the orbiting scroll 56 urging the orbiting scroll 56 toward the non-orbiting scroll 58.

One of the benefits of the compressor 10 of the present disclosure is that the diameter of the annular recess 92 and the sealing member 90 received therein is not dependent upon the diameter of the drive bearing 66. That is, the annular recess 92 and the sealing member 90 received therein may be made as small as possible (i.e., the diameter of the annular recess 92 and the sealing member 90 received therein may be disposed as far inward toward an edge 98 of the lower surface 72 as possible such that the biasing chamber 94 is sealed from the discharge chamber 24), thereby increasing the surface area of the biasing chamber 94 and the net axial biasing force on the orbiting scroll 56 urging the orbiting scroll 56 toward the non-orbiting scroll 58. This also facilitates machining of the orbiting scroll 56 as the annular hub 64 of the orbiting scroll 56 does not have to be machined to include additional components (e.g., radially extending components) for engaging the sealing member 90 and sealing the biasing chamber 94 from the discharge chamber 24.

In some configurations, where the drive bearing 66 is a needle bearing, for example, the hub bushing 22 may be made from hardened tool steel, thereby serving as an outer race for the needle bearing. It should be understood that the drive bearing may be a needle bearing, a sleeve bearing or any other suitable bearing.

Figure 4:
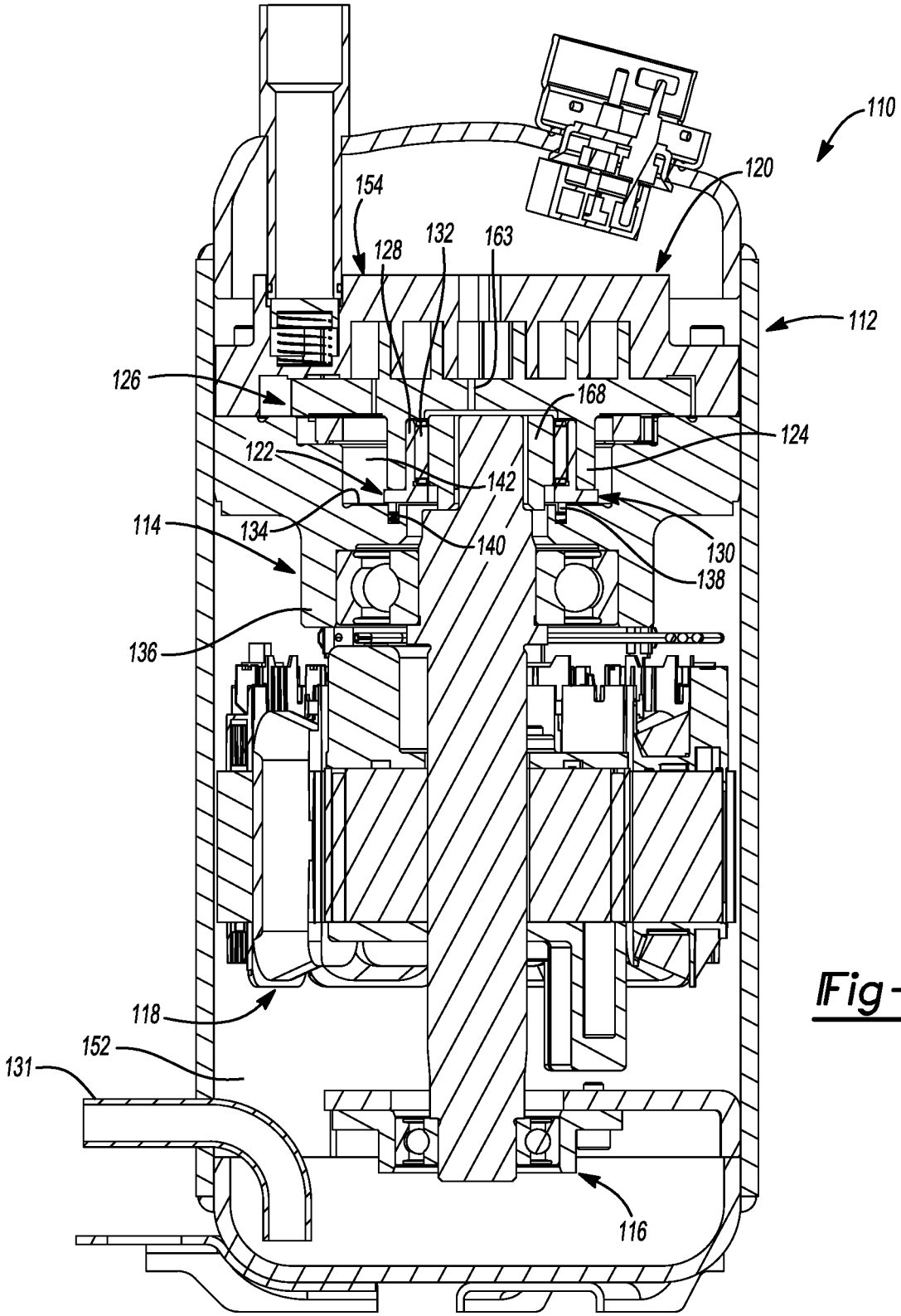
FIG. 4 is a cross-sectional view of another compressor having another bushing according to the principles of the present disclosure.
Figure 5:
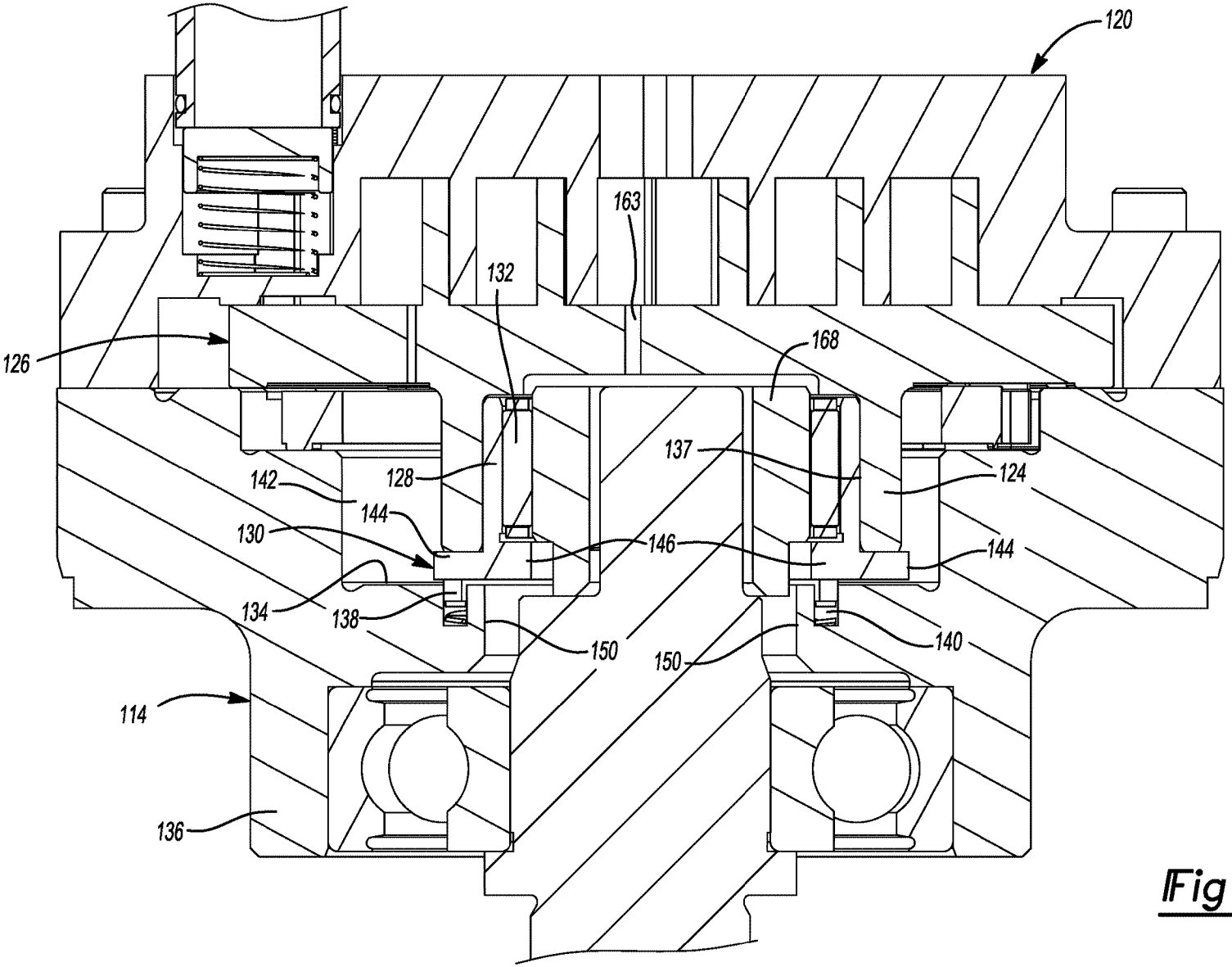
FIG. 5 is a partial cross-sectional view of the compressor of FIG. 4.
Figure 6:
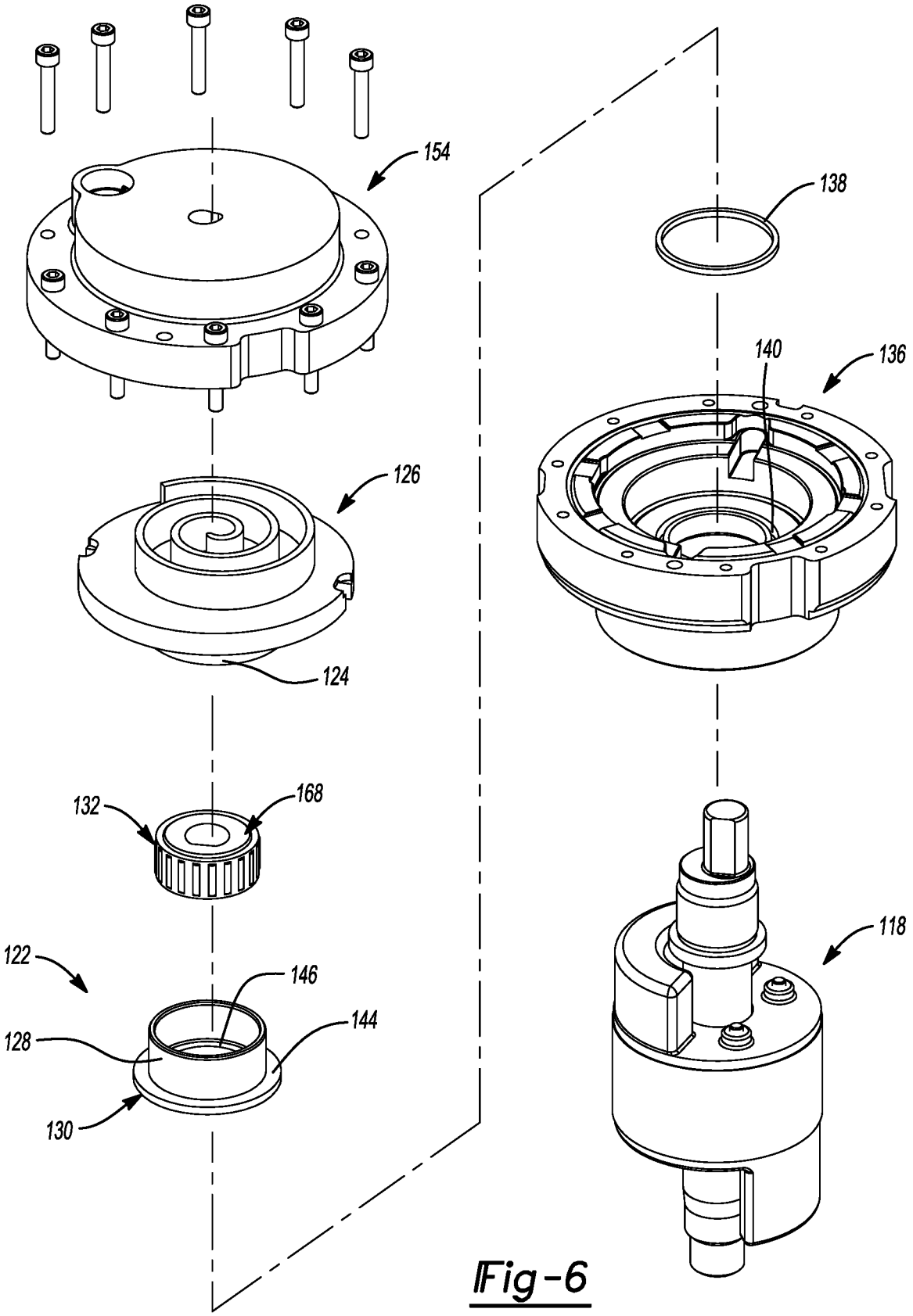
FIG. 6 is an exploded view of a compression mechanism, a motor assembly, a bearing assembly and the bushing of the compressor of FIG. 4.

With reference to FIGS. 4-6, another compressor 110 is provided. The compressor 110 may be generally similar to the compressor 10 described above, apart from any differences described below. The compressor 110 may be a high-side scroll compressor including a hermetic shell assembly 112, first and second bearing assemblies 114, 116, a motor assembly 118, a compression mechanism 120, a hub bushing 122 and an unloader bushing 168. The structure and function of the hermetic shell assembly 112, the first and second bearing assemblies 114, 116, the motor assembly 118, the compression mechanism 120 and the unloader bushing 168 may be similar or identical to that of the hermetic shell assembly 12, the first and second bearing assemblies 14, 16, the motor assembly 18, the compression mechanism 20 and the unloader bushing 68, respectively, described above, and therefore, will not be described again in detail. Briefly, the motor assembly 118 drives the compression mechanism 120 which compresses working fluid and discharges the compressed working fluid into the discharge chamber 152. Working fluid in the discharge chamber 152 may subsequently exit the compressor 110 through a discharge fitting 131.

As shown in FIGS. 4 and 5, the hub bushing 122 may be disposed within an annular hub 124 of an orbiting scroll 126 of the compression mechanism 120. The hub bushing 122 may be an annular member having a first member 128 (e.g., an axially extending portion) and a second member 130 (e.g., a radially extending portion). The first member 128 may be disposed axially within the hub 124 between the hub 124 and a drive bearing 132. In some configurations, the first member 128 may fixedly engage an inner diametrical surface 137 (FIG. 5) of the hub 124 by a press fit or interference fit, for example. In some configurations, a lubricant passage 163 may be formed in an end plate of the orbiting scroll 126 and may provide lubricant to the unloader bushing 168 and drive bearing 132 from a radially innermost fluid pocket.

The second member 130 may engage a sealing member 138 (e.g., an O-ring or annular seal) received in an annular recess 140 formed in a lower surface 134 of a first bearing housing 136 of the first bearing assembly 114 such that a biasing chamber 142 defined between the first bearing housing 136 and the orbiting scroll 126 is sealed.

The second member 130 may include a first end portion 144 and a second end portion 146 (FIG. 5). The first end portion 144 may extend radially outward from an axial end of the first member 128 and may be disposed between a distal axial end of the hub 124 and the lower surface 134 of the first bearing housing 136. The second end portion 146 may extend radially inward from the axial end of the first member 128 and may be disposed between the bearing 132 and the lower surface 134 of the first bearing housing 136. One or both of the first end portion 144 and the second end portion 146 may engage the sealing member 138 received in the annular recess 140 formed in the lower surface 134 to seal the biasing chamber 142.

One of the benefits of the compressor 110 of the present disclosure is that the diameter of the annular recess 140 and the sealing member 138 received therein is not dependent upon the diameter of the drive bearing 132. In this way, the annular recess 140 and the sealing member 138 received therein may be made as small as possible (i.e., the diameter of the annular recess 140 and the sealing member 138 received therein may be disposed as far inward toward an edge 150 of the lower surface 134 as possible such that the biasing chamber 142 is sealed from a discharge chamber 152 of the compressor 110), thereby increasing the surface area of the biasing chamber 142 and the net axial biasing force on the orbiting scroll 126 urging the orbiting scroll 126 toward a non-orbiting scroll 154 of the compression mechanism 120. In some configurations, the diameter of the sealing member 138 can be smaller than the diameter of the drive bearing 132.

During assembly of the drive bearing 132 and the hub bushing 122 to the hub 124 of the orbiting scroll 126, the drive bearing 132 is first disposed within the hub bushing 122 and then the hub bushing 122 is attached (e.g., press-fitted) to the hub 124 of the orbiting scroll 126.

While the compressors 10, 110 are described above as being high-side compressors (i.e., with the bearing assemblies, motor assembly, and compression mechanism disposed in the discharge chamber), it will be appreciated that the principles of the present disclosure are also applicable to low-side compressors. That is, the bearing assemblies, motor assembly, and compression mechanism of either of the compressors 10, 110 could be disposed in a suction chamber that is separated from a discharge chamber by a partition.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a non-orbiting scroll including a first spiral wrap;

an orbiting scroll including an end plate having a first side and a second side, the first side having a second spiral wrap extending therefrom and meshingly engaged with the first spiral wrap of the non-orbiting scroll to create fluid pockets therebetween; the second side having a hub extending therefrom;

a driveshaft having a crankpin received in the hub and driving the orbiting scroll;

a bearing housing;

a bushing including a first member and a second member, the first member disposed within the hub of the orbiting scroll between the hub and the crankpin of the driveshaft, the second member extending radially from an axial end of the first member and disposed between an axial end of the hub and a surface of the bearing housing;

a bearing disposed within the hub of the orbiting scroll between the first member of the bushing and the crankpin of the driveshaft; and an unloader bushing disposed within the hub of the orbiting scroll between the bearing and the crankpin of the driveshaft.

2. The compressor of claim 1, wherein the orbiting scroll and the bearing housing cooperate to define a biasing chamber.

3. The compressor of claim 2, wherein the bearing housing includes an annular recess formed in the surface thereof, and wherein a sealing member is received in the annular recess formed in the surface of the bearing housing.

4. The compressor of claim 3, wherein the second member extends radially outward from the axial end of the first member.

5. The compressor of claim 4, wherein the second member of the bushing engages the sealing member to seal the biasing chamber.

6. The compressor of claim 5, wherein the bearing is a needle bearing.

7. The compressor of claim 5, wherein a biasing passage is formed in the end plate of the orbiting scroll and provides fluid communication between one of the fluid pockets and the biasing chamber.

8. The compressor of claim 7, wherein the first member of the bushing is press-fitted to an inner diametrical surface of the hub.

9. The compressor of claim 3, wherein the second member of the bushing includes a first end portion and a second end portion, and wherein the first end portion extends radially outward from the axial end of the first member and the second end portion extends radially inward from the axial end of the first member.

10. The compressor of claim 9, wherein one or both of the first and second end portions of the second member engage the sealing member received in the annular recess formed in the surface to seal the biasing chamber.

11. A compressor comprising:

a non-orbiting scroll including a first spiral wrap;

an orbiting scroll including an end plate having a first side and a second side, the first side having a second spiral wrap extending therefrom and meshingly engaged with the first spiral wrap of the non-orbiting scroll to create fluid pockets therebetween; the second side having a hub extending therefrom;

a driveshaft having a crankpin received in the hub and driving the orbiting scroll;

an unloader bushing disposed on the crankpin of the driveshaft within the hub of the orbiting scroll;

a bearing housing including an annular recess formed in a lower surface thereof;

a bushing including a first member and a second member, the first member disposed within the hub of the orbiting scroll between the hub and the unloader bushing, the second member extending radially from an axial end of the first member and disposed between an axial end of the hub and a surface of the bearing housing; and a bearing disposed within the hub of the orbiting scroll between the first member of the bushing and the crankpin of the driveshaft.

12. The compressor of claim 11, wherein the orbiting scroll and the bearing housing cooperate to define a biasing chamber.

13. The compressor of claim 12, wherein a sealing member is received in the annular recess formed in the surface of the bearing housing.

14. The compressor of claim 13, wherein the second member extends radially outward from an end of the first member.

15. The compressor of claim 14, wherein the second member of the bushing engages the sealing member to seal the biasing chamber.

16. The compressor of claim 15, wherein a biasing passage is formed in the end plate of the orbiting scroll and provides fluid communication between one of the fluid pockets and the biasing chamber.

17. The compressor of claim 16, wherein the bearing is a needle bearing.

18. The compressor of claim 16, wherein the first member of the bushing is press-fitted to an inner diametrical surface of the hub.

19. The compressor of claim 13, wherein the second member of the bushing includes a first end portion and a second end portion, and wherein the first end portion extends radially outward from the axial end of the first member and the second end portion extends radially inward from the axial end of the first member.

20. The compressor of claim 19, wherein one or both of the first end portion and the second end portion engages the sealing member received in the annular recess formed in the surface to seal the biasing chamber.

* * * * *